US006901839B2

(12) United States Patent
Edberg et al.

(10) Patent No.: US 6,901,839 B2
(45) Date of Patent: Jun. 7, 2005

(54) BLAST ATTENUATION DEVICE AND METHOD

(75) Inventors: Donald L. Edberg, Irvine, CA (US); Stanley Schneider, Rancho Palos Verdes, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/656,709

(22) Filed: Sep. 5, 2003

(65) Prior Publication Data

US 2004/0118272 A1 Jun. 24, 2004

Related U.S. Application Data

(62) Division of application No. 10/313,834, filed on Dec. 6, 2002, now Pat. No. 6,805,035.

(51) Int. Cl.[7] ..... F41H 5/007

(52) U.S. Cl. ..... 89/36.17; 89/36.02

(58) Field of Search ..... 89/36.17, 36.02

(56) References Cited

U.S. PATENT DOCUMENTS

| | | | | |
|---|---|---|---|---|
| 417,798 | A | 12/1889 | Waggoner | |
| 2,865,674 | A | 12/1958 | Jelmeland | |
| 2,961,049 | A | 11/1960 | Toulmin, Jr. | |
| 3,703,930 | A | 11/1972 | Lofstrand et al. | |
| 3,804,017 | A | 4/1974 | Venable et al. | |
| 4,051,763 | A * | 10/1977 | Thomanek | 89/36.17 |

(Continued)

FOREIGN PATENT DOCUMENTS

| | | | | |
|---|---|---|---|---|
| GB | 2 234 334 A | * | 1/1991 | 89/36.17 |

OTHER PUBLICATIONS

Staten, Clark, "Bomb Deflection Device Offered in 1979", available at http://www.emergency.com/bomdeflc.htm, dated Sep. 3, 2002, 3 pages.

Explosion Hazards Limited, "Pressure Hot Water Explosion Suppression", available at http://www.explosionhazards.com/nav/phwes, 1 page.

Offshore Technology, "Gexcon–Gas Explosion Consultants", available at http://www.offshore–technology.com/contractors/safety/gexcon/index., 3 pages.

Jones, David, "Explosion Venting and Suppression of Bucket Elevator Legs", available at http://www.ianr.unl.edu/Pubs/safety/g990, 1997, 6 pages.

Landau, L. D. and E. M. Lifshitz, Problem 1, Fluid Mechanics, 1959, p. 248, vol. 6 of Course of Theoretical Physics, Addison–Wesley Publishing Company, Inc., Reading, Massachusetts.

United States Department of Defense, "Interation of Object with Air Blast", The Effects of Nuclear Weapons, Apr., 1962, pp. 177–183, United States Atomic Energy Commission, Washington, DC.

Kinney, Gilbert Ford, Explosive Shocks in Air, 1962, p. 94, The Macmillan Company, New York.

*Primary Examiner*—Stephen M. Johnson
(74) *Attorney, Agent, or Firm*—Alston & Bird LLP

(57) ABSTRACT

The present invention provides systems and methods for producing a shield for protecting an area from a pressure blast. The shield, which attenuates the pressure blast, can be used with tall, mobile, and underwater structures, including structures in densely populated areas. One system includes a source for providing an attenuation material, a delivery system that delivers the attenuation material to nozzles, and at least one valve device to control the delivery. A detector is configured to actuate the valve device to an open position in response to a perceived blast threat so that the delivery system delivers the attenuation material to form the shield proximate to a periphery of the protected area.

15 Claims, 3 Drawing Sheets

U.S. PATENT DOCUMENTS

| | | | | | |
|---|---|---|---|---|---|
| 4,718,356 | A | | 1/1988 | Caspe | |
| 4,903,573 | A | | 2/1990 | Browne et al. | |
| 4,964,329 | A | | 10/1990 | Moxon et al. | |
| 5,025,707 | A | | 6/1991 | Gonzalez | |
| 5,394,786 | A | | 3/1995 | Gettle et al. | |
| 5,400,688 | A | * | 3/1995 | Eninger et al. | 89/1.11 |
| 6,029,558 | A | * | 2/2000 | Stevens et al. | 89/36.17 |
| 6,119,574 | A | * | 9/2000 | Burky et al. | 89/36.04 |
| 6,128,999 | A | * | 10/2000 | Sepp et al. | 89/36.17 |
| 6,279,449 | B1 | * | 8/2001 | Ladika et al. | 89/36.17 |

* cited by examiner

BLAST ATTENUATION DEVICE AND METHOD

CROSS-REFERENCE TO RELATED APPLICATION

This application is a divisional of U.S. application Ser. No. 10/313,834, filed Dec. 6, 2002 now U.S. Pat. No. 6,805,035, which is hereby incorporated herein in its entirety by reference.

BACKGROUND OF THE INVENTION

1) Field of the Invention

The present invention relates to the attenuation of blasts and, in particular, to apparatuses and methods for attenuating blasts with a shield formed of attenuation, or absorptive, material.

2) Description of Related Art

An explosion is typically characterized by a blast or sharp increase in pressure that propagates in a wavelike manner outward from a point or area of origination. Whether intentionally or unintentionally initiated, such blasts can result in severe damage to buildings, vehicles, and personnel. For example, a blast from a bomb that is detonated in a car parked near a building can cause structural damage to the building, damage components therein, and/or injure people within the building. Similarly, ballistic and aerial explosive devices can cause costly damage to buildings and other types of structures. An explosion originating in a cargo container can rupture the container and propagate therefrom. Explosive blasts can also travel through media other than air, for example, an underwater blast that propagates to a boat, submarine, or other vessel and inflicts damage.

The use of barriers for attenuating the blasts associated with explosions is well known. For example, buildings at risk of blast damage during battle conditions are sometimes protected by walls formed of concrete, sand bags, and the like. Such dense barriers provide a protective effect to an area by deflecting and/or attenuating the blast and thereby preventing the blast from reaching the protected area or at least reducing the momentum or overpressure of the blast that does propagate to the area. In some cases, however, the blast may refract over or around the barrier and propagate into the protected area. Additionally, the construction of barrier devices can be prohibitively expensive, and such barriers can be impractical for protecting high structures, structures in densely populated regions, mobile structures, or underwater structures. Further, barriers can detract from the aesthetic appeal of a structure or area.

Thus, there exists a need for a blast attenuation device that provides an effective and space efficient shield for a protected area, including an area that includes a tall structure, a structure in a densely populated region, a mobile structure, or an underwater structure. The shield should be cost effective for construction, operation, and maintenance. Further, the shield should be adaptable to minimize the aesthetic impact of the shield or to render the shield aesthetically appealing.

BRIEF SUMMARY OF THE INVENTION

The present invention provides a system and method for producing a shield for protecting an area. The shield provides an attenuation of a pressure blast, and can be used with tall, mobile, and underwater structures, including structures in densely populated areas.

According to one embodiment, the present invention provides a shielding system for attenuating a pressure blast to shield a protected area. The system includes a source for providing an attenuation material, i.e., an absorbing material, and a delivery system with a plurality of nozzles fluidly connected to the source by one or more passages. A valve device is configured to control the delivery of the attenuation material through the nozzles. The valve device can be actuated by a detector in response to a perceived blast threat, for example, an approach of a blast originator toward the protected area. In one embodiment, pipes are disposed at a peripheral area of a building, and the nozzles can be configured to direct the shield to extend substantially vertically and proximate to walls of the building.

The source can provide solid attenuation particulates, water or other liquids that the nozzles deliver as droplets, or a gas delivered as bubbles in a liquid medium. The attenuation material can be delivered as particulates having an average size of between about 0.01 mm and 1.0 mm, and the shield can have a three dimensional, or volumetric, packing factor of between about 0.001 and 0.01. According to one aspect, the packing factor is non-uniform across its thickness, for example, to generally increase in a direction from the origination toward the protected area.

According to another embodiment, the present invention provides a pressure attenuation shield for attenuating a pressure blast and shielding a structure. The shield is formed of one or more sprays of attenuation material that are disposed proximate a periphery of the structure and between an origination of the pressure blast and the structure so that the shield attenuates the pressure blast by at least about 14.7 psi within a thickness of less than about 1 meter of the spray. According to one aspect, the shield includes first and second generally parallel walls disposed between an origination of the pressure blast and a protected area. A flexible host material such as a gelatinous fluid is disposed in the space between the walls, and an attenuation material is disposed as particulates suspended in the host material. The attenuation material is configured to attenuate the pressure blast and thereby reduce the pressure blast to below a damage threshold of a protected article in the protected area. The shield can be configured to form a cargo container.

The present invention also provides a method of attenuating a pressure blast to shield a protected area. The method includes detecting a threat of a pressure blast and, in response to the threat, spraying particulates to form the shield between an origination of the pressure blast and the protected area so that the shield attenuates the pressure blast from the origination.

Further, the present invention provides a method of constructing the system for attenuating a pressure blast and mitigating blast damage to a structure. The method includes determining a maximum initial pressure against which the structure is to be protected, determining an acceptable pressure to which the structure may be subjected, and selecting an attenuation material comprised of particles having a desired radius, mass density, and three-dimensional packing factor. A minimum thickness is determined, for example, according to a mathematical expression, for a particle mist of the attenuation material required to reduce the initial pressure to the acceptable pressure. A delivery system is mounted to the exterior surface of the structure such that the system is capable of providing the particle mist at least as thick as the determined minimum thickness.

BRIEF DESCRIPTION OF THE SEVERAL VIEWS OF THE DRAWINGS

Figure 1:
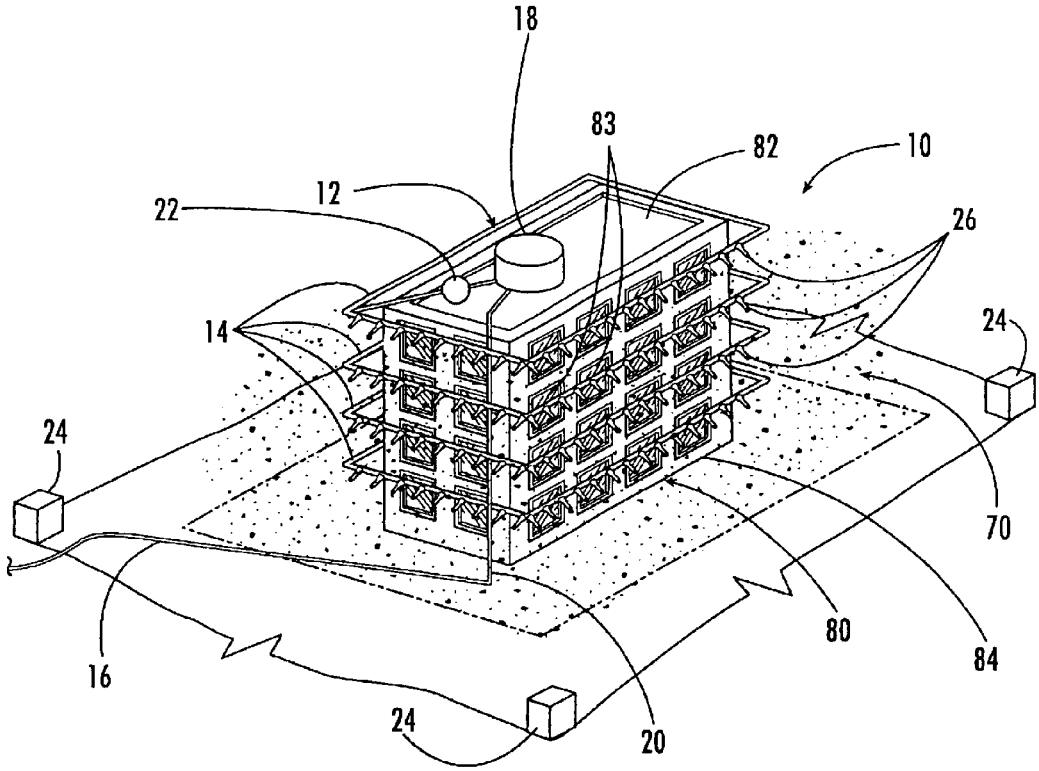
Figure 2:
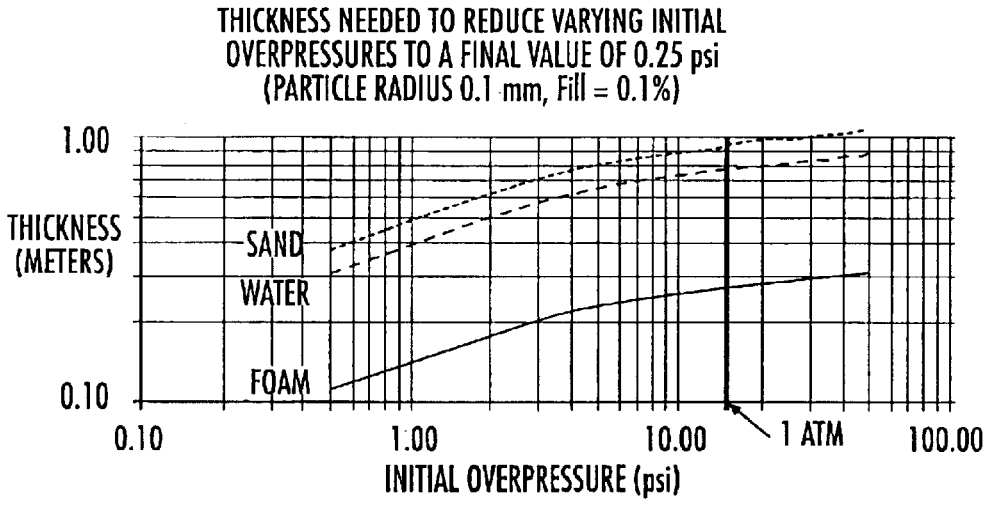
Figure 3:
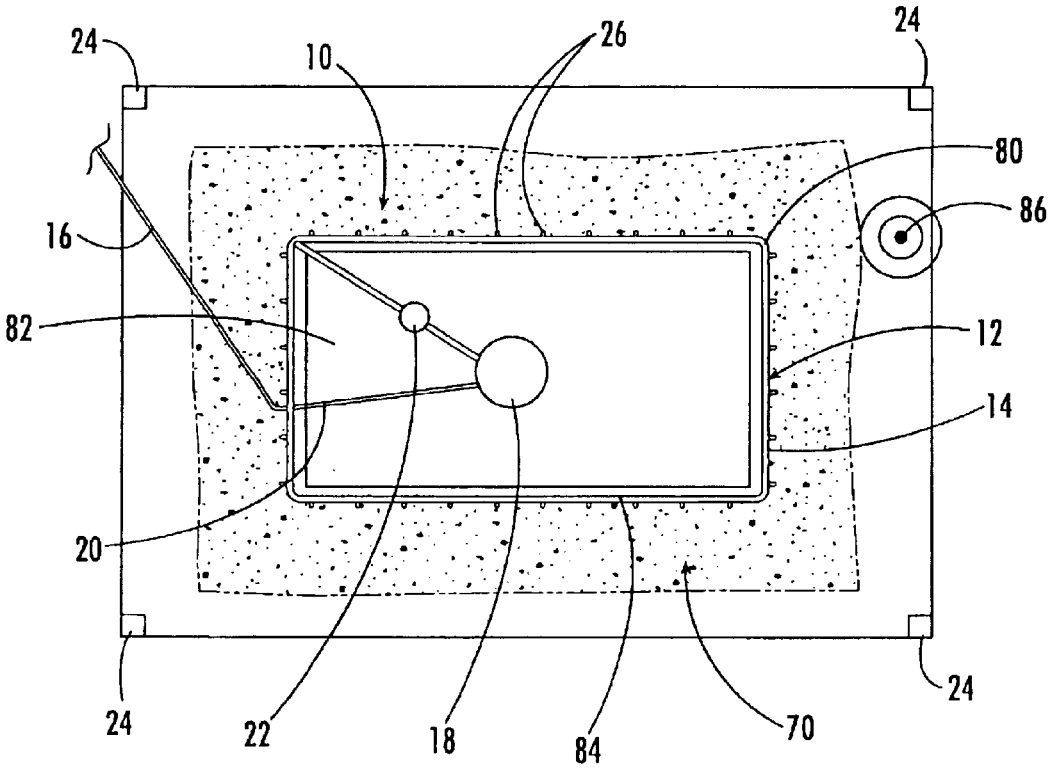
Figure 4:
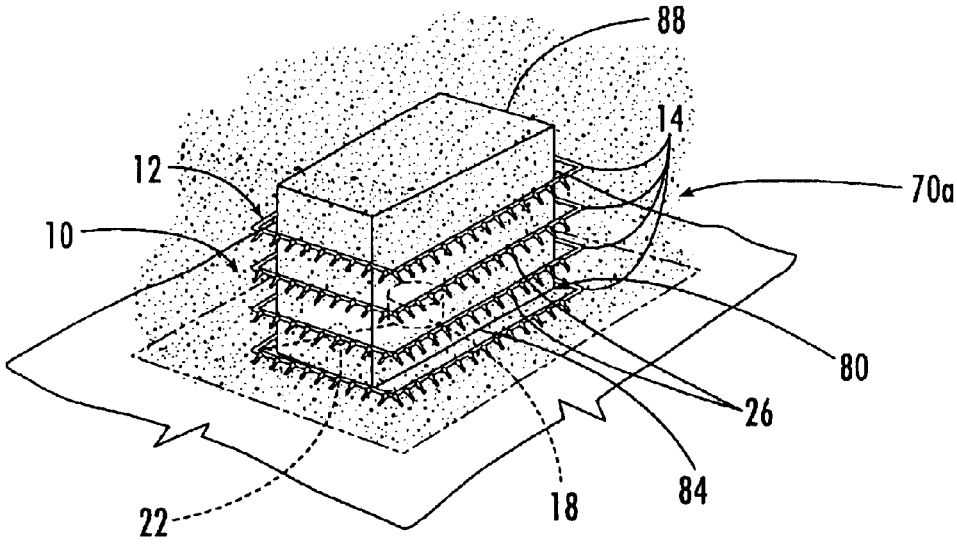
Figure 5:
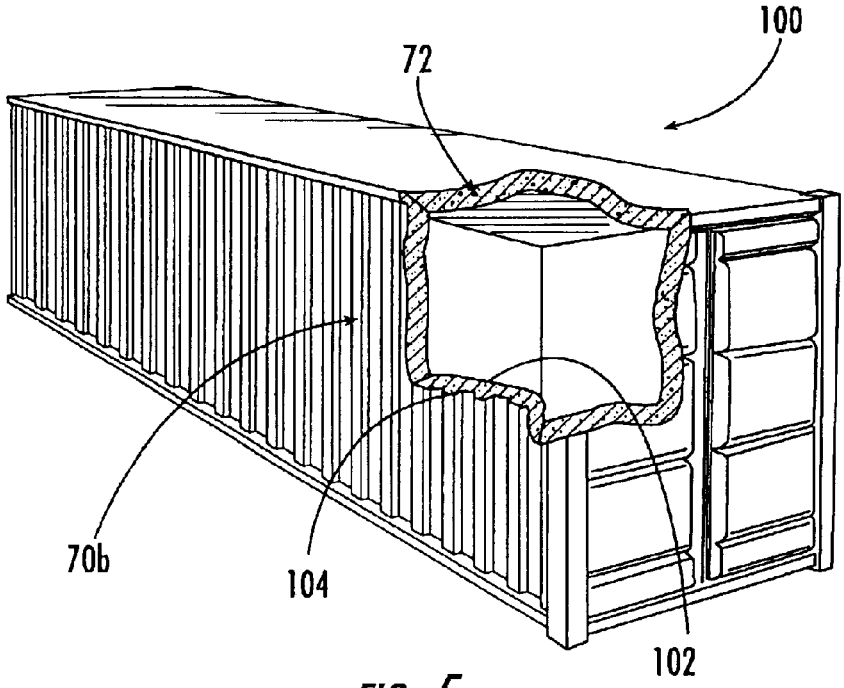

Having thus described the invention in general terms, reference will now be made to the accompanying drawings, which are not necessarily drawn to scale, and wherein:

FIG. 1 is perspective view of a blast attenuation system adapted to mitigate damage to a building according to one embodiment of the present invention;

FIG. 2 is a chart illustrating the thicknesses of blast attenuation shields of different particulate materials that are required for attenuating blast pressures to a final pressure of 0.25 psi;

FIG. 3 is a plan view of a blast shield with a non-uniform packing factor that partially reflects, partially attenuates, and partially transmits a blast shield according to one embodiment of the present invention;

FIG. 4 is a perspective view of a blast attenuation system adapted to mitigate damage to an underwater structure according to another embodiment of the present invention; and FIG. 5 is a perspective view of a shield that is configured to form a cargo container according to one embodiment of the present invention.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to the figures, and in particular FIG. 1, there is shown a blast attenuation system 10 according to one embodiment of the present invention, which is configured to provide an attenuation shield 70 around a protected area 80. The blast attenuation system 10 can similarly be used to protect other areas of any size and shape. Each protected area 80 can also include one or more structures such as buildings 82 or vehicles. The blast attenuation system 10 includes a delivery system 12 that includes a network of passages, such as pipes 14, disposed at an outer periphery 84 of the protected area 80. The pipes 14 can be formed of metal or plastic, and can be conventional pipes that are used in water distribution systems. The pipes 14 can be made an integral part of the building 82, for example, by locating the pipes 14 partially within the exterior walls of the building 82. Alternatively, the pipes 14 can be mounted on the exterior of the building 82 as shown in FIG. 1, for example, by adding the attenuation system 10 to the exterior of an existing building to thereby improve the protection of the building from blast damage. In any case, the attenuation system 10 can be designed to be visually unobtrusive or appealing, for example, by decorating the pipes 14 in a color or style that complements the exterior walls of the building 82.

The pipes 14 are fluidly connected to a source that provides an attenuation material for delivery through the pipes 14. The attenuation material can be a solid, liquid, or gas, as further described below. The source can be a water pipe that delivers water from a ground water supply 16 such as a public water supply system. Preferably, the source includes a reservoir that holds a volume of the attenuation material sufficient to provide the protective shield for at least a predetermined duration. For example, a water reservoir 18 can be located at the top of the building 82 and fluidly connected to the ground water supply 16 so that the attenuation system 10 remains operational even if a connection 20 to the ground water supply 16 is interrupted. The reservoir can also provide the attenuation material to other systems of the building 82, for example, a sprinkler system or other fire extinguishing system.

The attenuation system 10 can be operated continuously, but preferably a valve device 22 is configured to control the flow of the attenuation material from the reservoir 18 to the delivery system 12 so that the attenuation system 10 can be turned on and off by adjusting the valve device 22 between open and closed positions. The valve device 22 can be manually operable so that an operator can initiate the system 10, for example, to deploy the attenuation shield in response to a perceived blast threat. The valve device 22 can also be automatically operable by one or more detectors 24 configured to detect the perceived blast threat. For example, each detector 24 can be an optical or electromagnetic device adapted for detecting motion or heat and thereby detecting an unauthorized entry or approach to the protected area 80, such as an entry through a barricade, fence, or restricted area. The detector 24 can also be configured to receive a signal transmitted from a communication device or input by an operator. In one advantageous embodiment of the invention, the valve device 22 and detector 24 are configured to react quickly to the perceived blast threat so that the valve device 22 can be repositioned in response to a possible blast originator, such as a vehicle, entering the detection zone outside the protected area 80, and the shield 70 can be deployed before the possible originator reaches an outer periphery of the shield 70. The valve device 22 can be a fast-acting solenoid or pyrotechnic valve, for example, with a response time of 0.10 milliseconds or less.

The pipes 14 or other passages of the delivery system 12 are configured to deliver the attenuation matter to a plurality of nozzles 26. Preferably, the nozzles 26 are configured to deliver the attenuation material proximate to the periphery 84 of the protected area 80 and at least partially and, more commonly, completely surrounding the protected area 80. For example, the pipes 14 can extend horizontally around the protected area 80 so that the protected area 80 is entirely enclosed horizontally, and the nozzles 26 can be configured to spray the attenuation material to form the shield 70 vertically. The pipes 14 can also be disposed at multiple elevations, thereby providing a uniform shield, which can be deployed more quickly and more uniformly than a shield sprayed from a single pipe. For example, as illustrated in FIG. 1, the protected area 80 includes the building 82, and the pipes 14 are disposed at the top of the building 82 and at incrementally lower levels. Upon initiation of the system 10 depicted in FIG. 1, each of the nozzles 26 can begin spraying the attenuation material to form the shield 70 vertically. The shield 70 horizontally surrounds the building 82 such that a pressure blast originating outside the protected area 80 must propagate through the shield 70 to horizontally enter the protected area 80. The delivery system 12 can also extend over or under parts of the enclosed area 80, such as over a roof of the building 82, so that the shield 70 extends horizontally to protect the protected area 80 from vertical propagation of the pressure blast.

The shield 70 can be formed of any type of material or combination of materials. In addition to liquids such as water, the attenuation material can comprise any solid materials, for example, sand, grains, or polystyrene foam in particulate form, such as Styrofoam® pellets. By the term "solid" it is not meant that the attenuation particles must be solid throughout. For example, the attenuation material can comprise shelled objects such as hollow balls similar to the type commonly used for table tennis, which are formed of celluloid or other polymer materials. Solid attenuation particulates can be delivered through the delivery system 12 described above, for example, by blowing air through the delivery system 12 to propel the solid particulates to the nozzles 26, which can be adapted for delivering the solid particulates. The particulates can be collected in bins or drains located at the lower periphery of the protected area 80 below the nozzles 26, and the particulates can be reclaimed for re-use in the attenuation system 10 or for other uses. Further, the delivery system 12 can be configured to deliver the attenuation material in any direction. For example, the delivery system 12 can be disposed at the peripheral base of the protected area and configured to deliver the attenuation material upwards to form a vertically extending shield. The delivery system 12 can comprise pipes, as described above, or the attenuation material can be delivered from a tray or channel, which can also be used to reclaim the attenuation material.

The effective attenuation of the shield is influenced by the pressure blast, a thickness D of the shield 70, a radius r and density $\rho_p$ of the individual particles of the attenuation material, a three-dimensional packing factor F of the attenuation material, and a density $\rho_a$ of the ambient medium. The packing factor F is the ratio of the number of particles in a specific volume of the shield 70 relative to the maximum number of particles that can be disposed in the same volume. In one advantageous embodiment of the invention, the packing factor F is between about 0.001 and 0.01.

For cases where the density $\rho_p$ of the particles of the attenuation material is much greater than the density $\rho_a$ of the ambient medium, the required thickness D of the shield 70 for attenuating an initial pressure $P_i$ due to the pressure blast to a final pressure $P_f$ can be approximated by assuming that the attenuation material behaves according to a Brownian motion model. For example, the required thickness D can be determined according to the following equation:

$$D = 1.24\frac{r}{F^{\frac{11}{12}}}\left(\frac{\rho_p}{\rho_a}\right)^{\frac{1}{4}}\left[\ln\left(\frac{P_i}{P_f}\right)\right]^{\frac{1}{2}}$$

where the initial and final pressures $P_i$, $P_f$ are measured as overpressures or gauge pressures, i.e., pressures measured above the ambient pressure. Thus, if water is used as the attenuation material in an atmosphere of air at 100 kPa, the density $\rho_p$ of the particles is about 1 grams/cubic centimeter and, the density $\rho_a$ of the air is about 1.3 kilogram/cubic meter, and the thickness D of the shield 70 is given by:

$$D = 6.53\frac{r}{F^{\frac{11}{12}}}\left[\ln\left(\frac{P_i}{P_f}\right)\right]^{\frac{1}{2}}.$$

The thickness D of the shield 70 can be designed and adjusted according to the pressure blast threat and the necessary protection. For example, a bomb detonated outside the building 82 could cause a pressure blast to propagate to the building 82 and cause an initial overpressure pressure $P_i$ of about 100 kPa (14.7 psi) to occur temporarily outside the shield 70. Conventional windows, such as windows 83 on the building 82 of FIG. 1, typically break when subjected to an overpressure of about 0.5 psi, i.e., when the pressure outside the building 82 is 0.5 psi higher than the pressure within the building 82. FIG. 2 illustrates the attenuation effect of shields formed of sand, water, and polystyrene foam pellets with particles of radius r of 0.1 mm and a packing factor F of 0.001. As shown, the required thickness D for attenuating the blast to a final overpressure of 0.25 psi, i.e., so that the final pressure $P_f$ is only 0.25 psi higher than the ambient pressure, varies according to the attenuation material and the initial overpressure $P_i$. By reducing the final overpressure to only 0.25 psi, a safety factor of two is provided for preventing breakage of the windows 83 that are able to withstand an overpressure of 0.5 psi.

A variety of materials can be used for attenuation, and the thickness D can be adjusted according to the desired protection and the attenuation material. For example, an attenuation shield of water droplets with a radius r of 0.1 mm, a packing factor F of 0.001, and a thickness D of about 75 cm would reduce the initial pressure $P_i$ of 100 kPa (14.7 psi) to a final pressure $P_f$ of 0.25 psi, thus significantly reducing the probability that the windows 83 at the exterior of the building 82 will break. If the shield 70 is formed of droplets that are larger, for example, about 1 mm, the packing factor F can be increased to provide a similar attenuation effect. Similarly, if the shield is formed of a particles that are more or less dense than water, the thickness D or the packing factor F can be increased to provide a similar attenuation effect. Preferably, the attenuation material, radius r, and packing factor F, are selected so that the shield 70 attenuates an expected blast with an initial pressure $P_i$ greater than 100 kPa by at least about 0.1 psi per cm of thickness D. For example, the shield 70 can be configured to attenuate such a blast by least about 14.7 psi within a thickness of less than about 1 meter of the shield 70.

Further, the shield 70 can partially reflect the pressure blast away from the protected area 80 and thereby provide an additional protective effect to mitigate damage due to the blast. For example, upon impinging on the shield 70, a pressure blast is partially reflected and partially transmitted due to the variation in impedance characteristics between the shield 70 and the ambient medium that results from the mismatched densities $\rho_p$,$\rho_a$. Transmission into the shield 70 is enhanced if the densities $\rho_p$,$\rho_a$ and, hence, the impedances of the shield 70 and the ambient medium are closely matched, and reflectance is increased if the impedances are mismatched. In one embodiment, the nozzles 26 are configured to deliver the attenuation matter so that the shield 70 is non-uniform, or stratified, throughout its thickness so that the shield 70 defines a packing factor F that is higher in some portions of the shield 70 and lower in other portions. The shield 70 can be configured so that the non-uniformities affect the reflectance and absorption characteristics of the shield 70. For example, as shown in FIG. 3, the packing factor F can be made to increase in a direction extending from an origination 86 of a pressure blast toward the protected area 80 so that the pressure blast first impinges on the portion of the shield 70 where the packing factor F is lowest and then propagates through shield portions with increasingly higher packing factors F. Thus, the impedance of the shield 70 at an outer periphery of the shield 70 is closely matched to the ambient medium, and the reflection of the blast is minimized so that the pressure blast is transmitted into the shield 70 and attenuated therein. Further, the nozzles 26 are configured to deliver the attenuation material such that the packing factor F is highest at an inner periphery of the shield 70 so that the impedance of the shield 70 is mismatched with the ambient medium. Thus, after the pressure blast propagates to the inner periphery of the shield 70, the impedance mismatch causes the blast to be partially reflected away from the protected area 80 and transmitted again through the shield 70 for further attenuation therein. Alternatively, the nozzles 26 can be configured to deliver the attenuation material such that the shield 70 has a high packing factor F at its outer periphery so that initial reflectance of the pressure blast is increased. In some cases, absorption of the pressure blast may be preferable to reflectance. For example, if the building 82 is located among other structures, reflectance of the pressure blast therefrom may increase the damage to the other nearby structures. Further, subsequent reflections of the blast may impinge on other portions of the building 82 that are not protected by the shield 70, such as the roof of the building 82.

According to another advantageous embodiment of the present invention, the attenuation material can comprise a gas such as air disposed as bubbles in a liquid medium. For example, FIG. 4 illustrates a delivery system 12 that comprises a network of pipes 14 configured at the periphery 84 of the protected area 80 that includes an underwater structure 88 such as a submarine. The nozzles 26 are configured to deliver the air to form bubbles in the ambient medium, which is water in this embodiment. The air bubbles, which rise in the water, provide a shield 70*a* for protecting the protected area 80 from pressure blasts that propagate through the water, for example, originating from an underwater explosive such as a depth charge. The shield 70*a* can provide an attenuating effect similar to the effect described above. Additionally, the impedance mismatch between the shield 70*a* and the water can result in significant reflectance of the pressure blast away from the protected area thereby decreasing the final pressure $P_f$ of the blast that propagates to the protected area 80 and mitigating the damage of the blast.

Although the shields 70, 70*a* are described above as a spray of the attenuation material, the particulates of the attenuation material can alternatively be configured as a static shield. For example, solid particulates can be embedded in a solid or liquid medium such as a flexible host material, such as sponge, feathers, foam, or gel, which is positioned between the protected area and the possible location of a blast origination. In one embodiment, illustrated in FIG. 5, a shield 70*b* is configured to form a double-hulled cargo container 100. The container 100 defines a space between an inner wall 102 and an outer wall 104. Particulates 72 of the attenuation material are disposed between the inner and outer walls 102, 104, in the flexible host material that fills space. For example, particulates formed of sand, foam, or other materials can be disposed in any a gelatinous fluid or any other flexible host material. The shield 70*b* can be used to mitigate damage outside the container 100, that results from a blast originating within the container 100 or to mitigate damage within the container 100 from a blast outside the container 100. For example, if a bomb that is transported within the container 100 explodes, the shield 70*b* would mitigate damage to the vehicle transporting the container 100 as well as other cargo being transported by the vehicle. Preferably, the shield 70*b* provides sufficient attenuation to reduce an expected pressure blast to below a damage threshold of articles in the protected area. The protected articles can include cargo in the container 100, other cargo near the container 100, a vehicle used to transport the container 100, and the like. The appropriate thickness D of the shield 70*b* can be determined according to the foregoing discussion.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A pressure attenuation shield for attenuating a pressure blast and shielding a structure, the shield comprising:

a spray of attenuation material disposed proximate a periphery of the structure and between an origination of the pressure blast and the structure such that the shield attenuates the pressure blast by at least about 14.7 psi within a thickness of less than about 1 meter of the spray, wherein the attenuation material is disposed as particulates having an average size of between about0.01 mm and 1.0 mm.

2. A pressure attenuation shield according to claim 1 wherein the shield extends substantially vertically and horizontally about at least a portion of the structure.

3. A pressure attenuation shield according to claim 1 wherein said attenuation material comprises water droplets having an average size of between about 0.01 mm and 1.0 mm.

4. A pressure attenuation shield according to claim 1 wherein said attenuation material comprises solid particles of at least one of the group consisting of sand and polystyrene.

5. A pressure attenuation shield according to claim 1 wherein said attenuation material comprises gaseous bubbles and said shield extends through a liquid medium.

6. A pressure attenuation shield according to claim 1 wherein a three dimensional packing factor of said attenuation material is between about 0.001 and 0.01.

7. A pressure attenuation shield according to claim 1 wherein a three dimensional packing factor of said attenuation material is non-uniform across a thickness of the shield and generally increases in a direction from the origination toward the structure.

8. A method of attenuating a pressure blast to shield a protected area, the method comprising:

detecting a threat of a pressure blast; and in response to the threat, spraying particulates to form a shield extending between an origination of the pressure blast and the protected area such that the shield attenuates the pressure blast from the origination by at least about 14.7 psi within a thickness of less than about 1 meter of the particulates of the shield, wherein said spraying step comprises sprayin the particulates with an average size of between about 0.01 mm and 1.0 mm.

9. A method according to claim 8 wherein spraying particulates comprises spraying at least one of the group consisting of water droplets, sand, and polystyrene.

10. A method according to claim 8 wherein spraying particulates comprises spraying a fluid from pipes disposed at a peripheral area of the protected area such that the shield extends substantially vertically downward and in a horizontal direction about at least a portion of the protected area.

11. A method according to claim 8 further comprising spraying the particulates such that the shield has a three dimensional packing factor of between about 0.001 and 0.01.

12. A method according to claim 8 further comprising spraying the particulates such that the packing factor generally increases in a direction from the origination of the pressure blast toward the structure.

13. A pressure attenuation shield for attenuating a pressure blast and shielding a structure, the shield comprising:

a spray of attenuation material disposed proximate a periphery of the structure and between an origination of the pressure blast and the structure such that the shield attenuates the pressure blast by at least about 14.7 psi within a thickness of less than about 1 meter of the spray, wherein said attenuation material comprises solid particles of at least one of the group consisting of sand and polystyrene.

14. A pressure attenuation shield for attenuating a pressure blast and shielding a structure, the shield comprising:

a spray of attenuation material disposed proximate a periphery of the structure and between an origination of the pressure blast and the structure such that the shield attenuates the pressure blast by at least about 14.7 psi within a thickness of less than about 1 meter of the spray, wherein a three dimensional packing factor of said attenuation material is between about 0.001 and 0.01.

15. A method of attenuating a pressure blast to shield a protected area, the method comprising:

detecting a threat of a pressure blast; and in response to the threat, spraying particulates to form a shield extending between an origination of the pressure blast and the protected area such that the shield attenuates the pressure blast from the origination by at least about 14.7 psi within a thickness of less than about 1 meter of the particulates of the shield, such that the shield has a three dimensional packing factor of between about 0.001 and 0.01.

* * * * *

UNITED STATES PATENT AND TRADEMARK OFFICE

CERTIFICATE OF CORRECTION

PATENT NO. : 6,901,839 B2
DATED : June 7, 2005
INVENTOR(S) : Edberg et al.

It is certified that error appears in the above-identified patent and that said Letters Patent is hereby corrected as shown below:

Column 8,
Line 19, “about0.01 mm” should read -- about 0.01 mm --.
Line 53, “sprayin” should read -- spraying --.

Signed and Sealed this

Thirtieth Day of August, 2005

JON W. DUDAS
*Director of the United States Patent and Trademark Office*